United States Patent [19]

Nemoto et al.

[11] 4,091,630

[45] May 30, 1978

[54] INTERMEDIATE SLEEVE FOR INSTALLING PIPELINE BY PROPELLING PIPES UNDERGROUND

[75] Inventors: Yukiyasu Nemoto, Ibaraki; Kyosuke Nanba, Kawanishi, both of Japan

[73] Assignee: Kubota, Ltd., Osaka, Japan

[21] Appl. No.: 793,361

[22] Filed: May 3, 1977

[51] Int. Cl.[2] ..... F16L 1/00; E01G 3/04; E01G 5/14

[52] U.S. Cl. ..... 61/72.7; 61/42; 61/84; 61/85

[58] Field of Search ..... 61/84, 85, 42, 45 R, 61/63, 72.7, 43; 299/31-33, 11

[56] References Cited

U.S. PATENT DOCUMENTS

| | | | |
|---|---|---|---|
| 1,948,707 | 2/1934 | Gilman | 61/85 |
| 3,005,314 | 10/1961 | Cunningham | 61/84 X |
| 3,169,376 | 2/1965 | Cunningham | 61/84 X |
| 3,708,984 | 1/1973 | Coleman | 61/85 X |
| 3,733,835 | 5/1973 | Jacobs | 61/84 |

FOREIGN PATENT DOCUMENTS

| | | | |
|---|---|---|---|
| 1,173,034 | 6/1964 | Germany | 61/84 |
| 280,199 | 12/1928 | United Kingdom | 61/85 |

*Primary Examiner*—Dennis L. Taylor
*Attorney, Agent, or Firm*—Eric P. Schellin

[57] ABSTRACT

An improved form of intermediate sleeve for installing a pipeline by forcing pipes into earth, incorporating the sleeve into the resulting pipe assembly at an intermediate portion thereof, and pushing the rear end of the pipe assembly and telescopically extending the sleeve alternately in repetition to thereby propel the assembly. The intermediate sleeve comprises a socket member, a spigot member slidably fitting in the socket member and includes a sealing portion in the vicinity of a sliding portion between the members. The intermediate sleeve is usable as part of the pipeline after the completion of the propulsion without the necessity of providing any additional special seal. The intermediate sleeve can be equipped with a feeder device for feeding a lubricant into the sliding portion and for withdrawing the same therefrom during collapsing movement to completely prevent the ingress of soil or sand into the sliding portion. The intermediate sleeve can be further provided with a special jack supporting structure by which intermediate jacks are readily progressively mountable on circumferentially spaced portions of the sleeve via progressive mounting thereof at its lower portion.

8 Claims, 18 Drawing Figures

INTERMEDIATE SLEEVE FOR INSTALLING PIPELINE BY PROPELLING PIPES UNDERGROUND

BACKGROUND OF THE INVENTION

This invention relates to intermediate sleeves for installing piplines by propelling pipes underground as joined together end-to-end, and more particularly to improvements in a sleeve comprising a spigot member and a socket member telescopically fitted together and adapted to be incorporated into an underground pipeline at an intermediate portion thereof.

Heretofore it has been practiced to force cast iron pipes, steel pipes or the like directly into earth by a method, which may be termed "propulsion method," for the installation of underground pipelines where there is the necessity of laying the pipeline beneath railways, rivers or roads, or urban areas with heavy traffic where it is impossible to excavate the ground. According to the basic prior art method, a starting pit is first formed in the ground at one end of the pipeline to be installed, and pipes are joined together end-to-end one after another, such that the axially aligned pipe assembly is forced at its rear end into the earth by propelling means, such as hydraulic jacks, provided in the starting pit so as to cause the front end of the pipe assembly to ultimately reach a terminal pit at the other end of the line responsive to progressive lengthening the assembly. However, the propelling capacity of the hydraulic jacks is limited, and the pipe assembly is subjected to an increasing reaction or counterforce with an increase in the overall length of the assembly, with the result that the assembly, when exceeding a certain length, may possibly be buckled or broken down. Thus, there is an inevitable limitation on the length of the pipeline which can be installed only with the use of the propelling means provided in the starting pit.

In order to overcome this drawback, heretofore it has been proposed to incorporate a telescopic intermediate sleeve means into the pipe assembly at an intermediate portion thereof and to propel the pipe assembly in the manner of vermiculation by pushing the rear end of the assembly and extending the intermediate sleeve means alternately in repetition while progressively lengthening the pipe assembly. More specifically, the intermediate sleeve means comprises a spigot member, i.e. basically an inner pipe, and a socket member, i.e., basically an outer pipe, which are telescopically fitted together. At an intermediate portion of the pipe assembly, one of the socket members is joined to the rear end of a pipe, with one of the complemental spigot members joined to the front end of the next pipe. The intermediate sleeve means is telescopically extended or stretched by propelling means, such as hydraulic jacks, provided on the inner surface of the sleeve to thereby advance the front segment of the pipe assembly. Subsequently, the rear segment of the assembly following the sleeve is advanced by propelling means in the starting pit while collapsing or contracting the sleeve. The pipe assembly is advanced in its entirety by repeating this procedure.

However, the propulsion method employing such previously known intermediate sleeves has some drawbacks notwithstanding its outstanding advantages. First, since the intermediate sleeve eventually constitutes part of the pipeline, there is the necessity of sealing the joint between the spigot member and the socket member of the sleeve after the completion of the propulsion. However, this is very difficult and requires much labor to assemble at the intermediate portion of the underground pipeline a mechanical seal. Such prior art sleeves have been of complex structure such as an inner joint comprising a rubber ring, a divided ring and a pushing ring as illustrated at the left side end in FIG. 3 of the accompanying drawings. Moreover, since the spigot member and the socket member are telescopically fitted together, soil or sand is liable to enter the sliding portion between the members, consequently interfering with or preventing a smooth telescoping movement. Although such intermediate sleeves are usually provided with a cover plate extending from the spigot member intended to prevent the ingress of soil or sand, the prior art seal and plate arrangements generally fail to completely seal off the sliding portion against soil or sand during the repetitive telescoping movement, rendering the members no longer smoothly slidable on each other. Another problem of the prior art systems is encountered with the use of jacks which are usually mounted on the inner peripheral surface of the socket member by suitable brackets. With an increase in the diameter of the pipe, jacks of greater weight are used in an increased number, necessitating increasingly cumbersome procedures for the installation and removal of the jacks. In particular, jacks are difficult to mount on and remove from the upper peripheral portion of the socket member. Indeed, extreme difficulties are experienced in following such prior art procedures at an intermediate portion of the underground pipe assembly.

SUMMARY OF THE INVENTION

Accordingly, this invention provides for improved intermediate sleeves free of the foregoing disadvantages.

An object of this invention is to provide such intermediate sleeve means in the vicinity of its sliding portion with an improved seal of the self-sealing type which, when subjected to the internal pressure of the sleeve, gives the surface pressure required for completely and effectively sealing, rendering the sleeve more effectively usable as part of a pipeline after the completion of propulsion.

Another object of this invention is to provide an intermediate sleeve means in which lubricating means are provided whereby a lubricant can be fed under pressure into the variable space adjacent the sliding portion of the sleeve so as to effectively seal off the sliding portion against soil or sand.

Still another object of this invention is to provide an intermediate sleeve means having an improved support structure substantially circular in its entirety and rotatable on the inner peripheral surface of the sleeve, the support structure being adapted to support jacks or like propelling means between the structure and the inner peripheral surface and thereby rendering the propelling means mountable with extreme ease at a lower position within an elongated pipe assembly intermediately thereof.

These and other objects of this invention will become more apparent from the following description given with reference to the accompanying drawings.

BRIEF DESCRIPTION OF THE DRAWINGS

FIGS. 6(I) to (IV) are diagrammatic longitudinal views showing a pipe assembly incorporating the intermediate sleeve means of this invention in the course of a propelling operation to illustrate the operation in succession; FIG. 6(I) showing the pipe assembly before base jacks and intermediate jacks on the sleeve are operated; FIG. 6(III) showing the pipe assembly when the base jacks have been operated; and FIG. 6(IV) showing the pipe assembly with another pipe joined to the near end of the assembly and held at its rear end by the base jacks;

DESCRIPTION OF THE PREFERRED EMBODIMENTS

Figure 1:
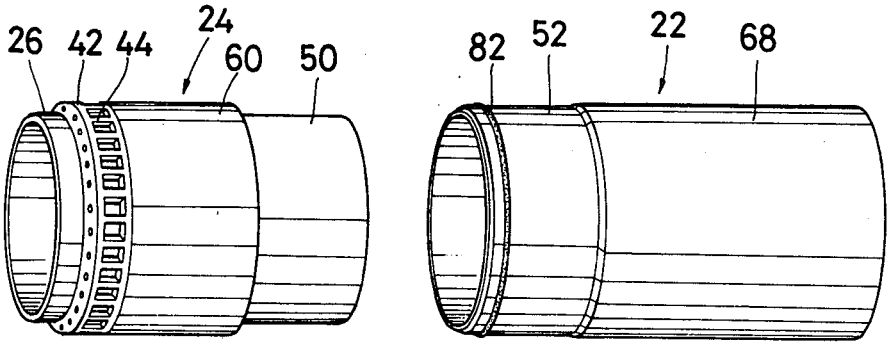
FIG. 1 is an exploded perspective view of an intermediate sleeve means usable in this invention and comprising a socket member and a spigot member as these members are disassembled from each other.
Figure 2:
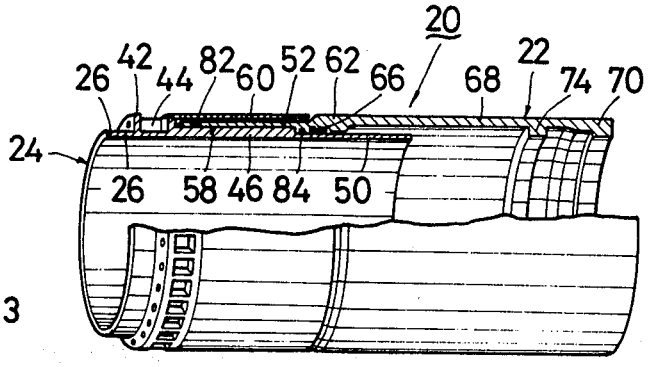
FIG. 2 is a perspective view partly broken away and showing the socket member and the spigot member of FIG. 1 assembled together, the intermediate sleeve means being shown in its wholly collapsed or compressed state, with intermediate jacks omitted.
Figure 3:
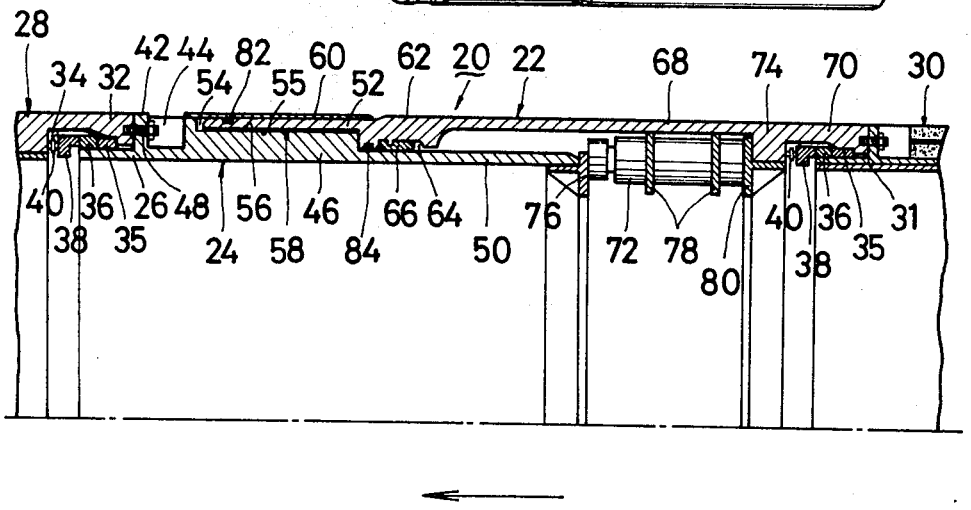
FIG. 3 is an enlarged cross-sectional longitudinal half view showing the intermediate sleeve means in its collapsed or compressed state in operative association with pipes at the opposite ends thereof.

With reference to FIGS. 1 to 8, in intermediate annular sleeve means 20 according to this invention comprises the combination of a socket member 22 serving as an outer pipe member, and a spigot member 24 slidably fitting into the socket member 22 and serving as an inner pipe member. The spigot member 24 is joined to a pipe 28 disposed to the front thereof toward the direction of propulsion, and the socket member 22 to a rear pipe 30. In the illustrated position, the spigot member 24 has on its left-hand side, i.e., on the front (direction of travel) side, a front spigot end 26 of relatively small wall thickness to be inserted into and joined to the socket end 32 of the pipe 28. The pipe 28 has a recessed portion 34 in the inner peripheral surface of its socket end 32 adjacent the extremity of the end. The recessed portion 34 and the outer peripheral surface of the front spigot end 26 of the spigot member 24 define therebetween a space, which accommodates a rubber ring 35, a divided ring 36 and a pushing ring 38 having bolts 40 screwed therein. The bolts 40, when turned, force the pushing ring 38 inward, causing the divided ring 36 to push the rubber ring 35 into the innermost portion of the space, whereby a mechanical seal is provided as an "internal joint," generally as already known among the prior art devices. The seal affords a watertight joint between the front spigot end 26 of the spigot member 24 and the socket end 32 of the pipe 28. The front spigot end 26 of the spigot member 24 extends into an intermediate portion 46 of increased thickness, with a radial flange 42 formed therebetween. A large number of reinforcing the ribs 44 disposed circumferentially, equidistantly spaced apart are provided between the intermediate portion 46 and the flange 42. Bolts 48 secure the flange 42 to the socket end 32 of the pipe 28 bearing against the flange 42 for transmitting a propelling force and for preventing bending of the pipeline during propulsion.

Figure 4:
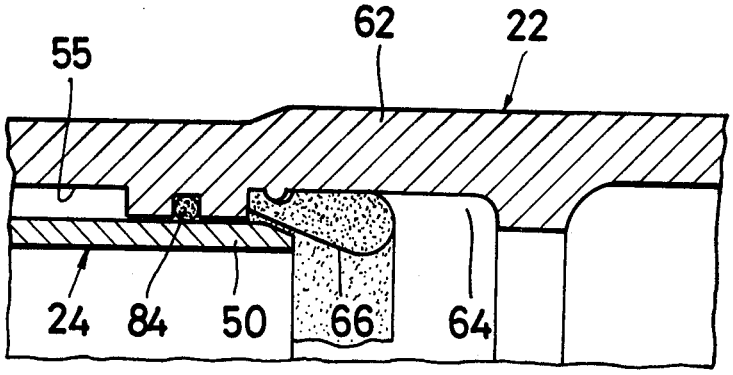
FIG. 4 is a fragmentary longitudinal cross-sectional view on an enlarged scale showing a sealing member before the socket member and the spigot member are forceably assembled together.
Figure 5:
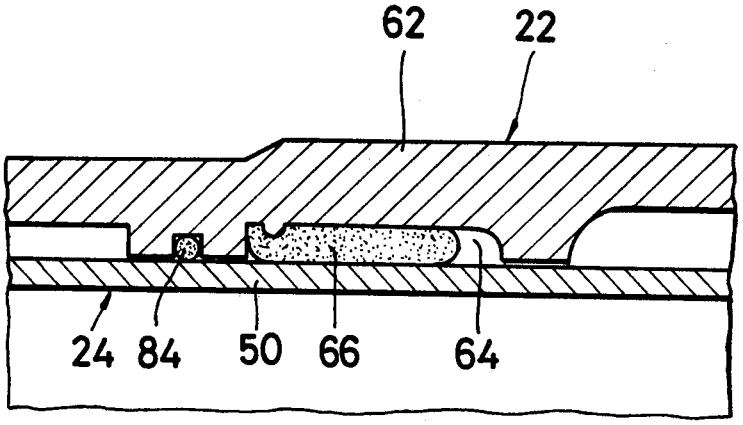
FIG. 5 is a fragmentary longitudinal cross-sectional view on an enlarged scale showing the sealing member compressively extruded after the socket member and the spigot member are assembled together.

The intermediate portion 46 of the spigot member 24 has substantially the same outside diameter as the flange 42 where the portion adjoins the ribs 44, and extends rearward with a slightly reduced thickness to provide a space 54 for permitting the front end 52 of the socket member 22 to slidably move upon the intermediate portion 46. The intermediate portion 46 further extends into a rear spigot end 50 of still smaller thickness. The inner peripheral surface 55 of the front end 52 of the socket member 22 (FIGS. 3 and 8) and the outer peripheral surface 56 of the intermediate portion 46 of the spigot member 24 are slidable upon each other. Thus, these surfaces 55 and 56 constitute a sliding portion 58. The intermediate portion 46 of the spigot member 24 is provided with a cylindrical cover plate 60 covering the space 54 and having an open rearward end. The cover plate is designed to prevent the ingress of soil or sand. The front end 52 of the socket member 22 extends rearward and is integrally formed with a thicker walled annular portion 62. A groove 64 is formed in the inner peripheral surface thereof for accommodating a rubber ring 66, thus providing a sealing portion. FIGS. 4 and 5 show on an enlarged scale, the sealing rubber ring 66 before and after the spigot member 24 and the socket member 22 are assembled together. The rubber ring 66 is of the self-sealing type capable of giving the surface pressure required for sealing when subjected to the internal pressure of the sleeve. The outer peripheral surface of the rear spigot end 50 of the spigot member 24 is slidably in contact with the rubber ring 66, thus, the rear spigot end 50 must have a length sufficient to be held in contact with the rubber ring 66 at all times whether the intermediate sleeve in in an extended state or in a telescopically compressed or collapsed state.

The thicker wall portion 62 of the socket member 22 continues rearwardly into a slightly thinner wall portion 68 which terminates in an integrally formed rearward socket end 70. The rearward socket 70 is adapted to be joined to the front spigot end 31 of the rear pipe section 30. These respective ends 70 and 31 are joined and sealed together in the same manner by the same numbered parts as described for the spigot end 26 of the spigot member 24 and the socket end 32 of the front pipe 28. Thus, this joint will not be described again.

Intermediate jacks 72 (FIG. 8) are provided between the rear spigot end 50 of the spigot member 24 and a rib 74 formed on the inner peripheral surface of the partially thinner wall portion 68 of the socket member 22. The rib 74 is adapted to receive the counterforce of the intermediate jacks 72. Indicated at 76 is an annular abutment member disposed on the rear spigot end 50, and indicated at 80 is a rearward abutment and support for the jacks 72, the latter of which are also held by brackets 78.

An O-ring 82 fitting around the outer peripheral surface of the front end portion 52 of the socket member 22 seals off the sliding portion 58 from the outside. Another O-ring 84 fitting in the inner peripheral surface of the socket member in the thicker wall portion 62 seals off the sliding portion 58 from the interior of the sleeve and thus protects sealing ring portion 66.

Figure 6:
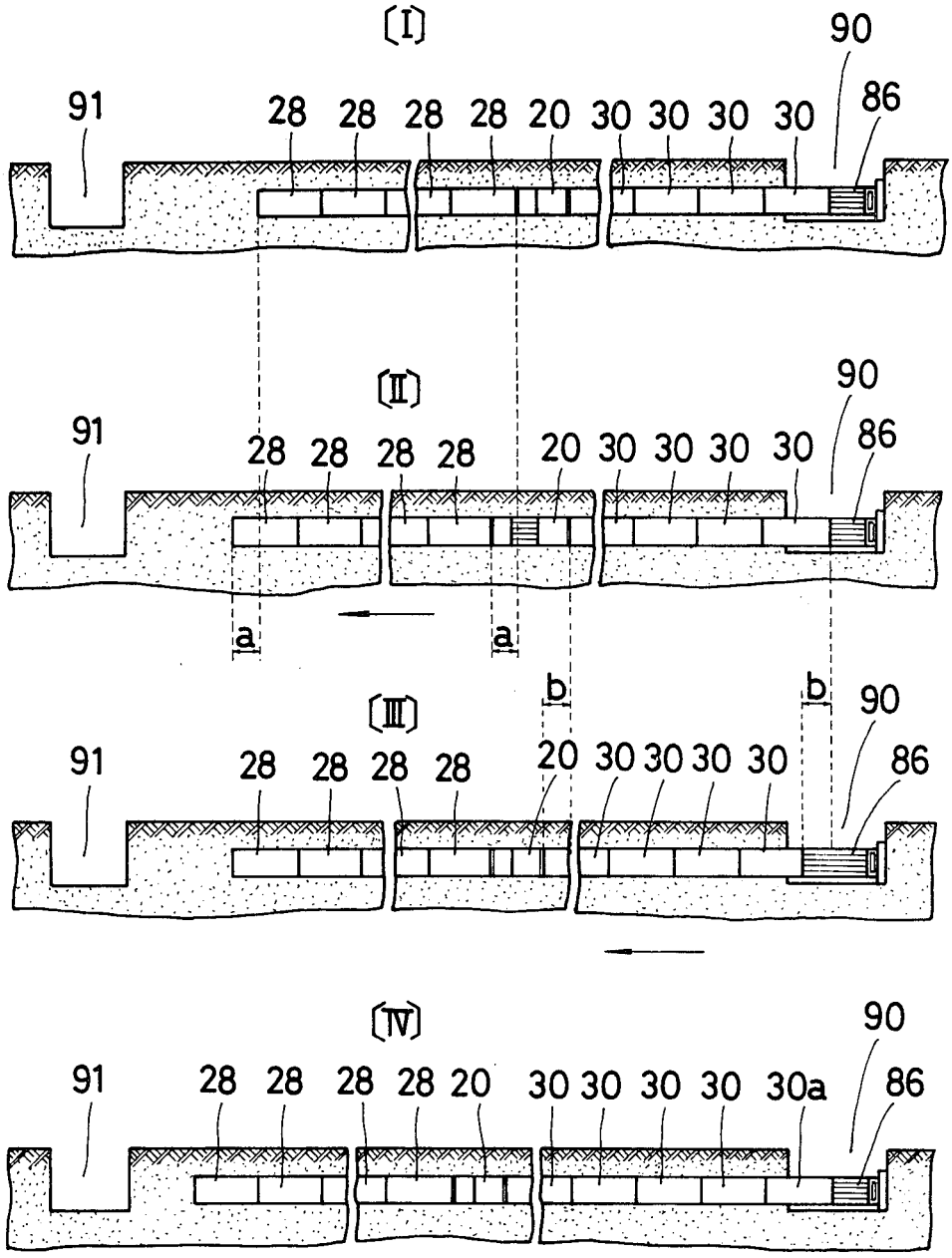
FIG. 6(II) showing the pipe assembly when the intermediate sleeve is in its extended state.
Figure 7:
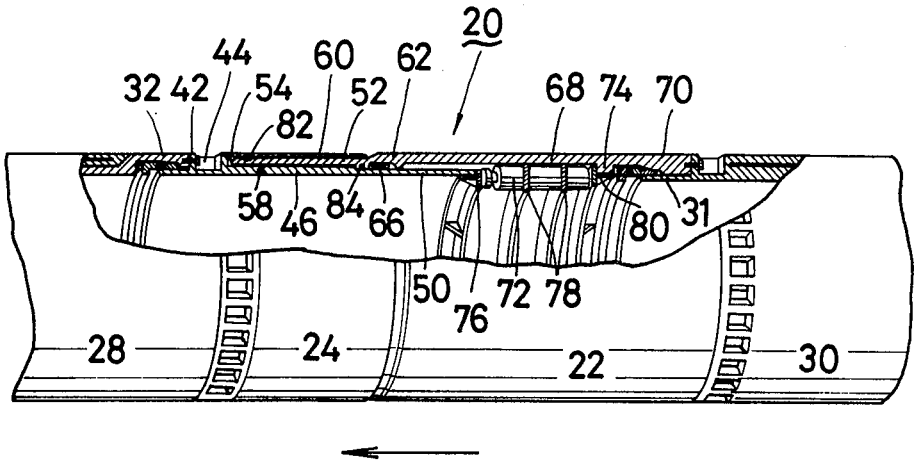
FIG. 7 is a perspective view partly broken away and showing the intermediate sleeve and the pipes joined to the opposite ends of said sleeve while the intermediate jacks are out of operation, the view thus corresponding to FIGS. 6(I), (III) and (IV)
Figure 8:
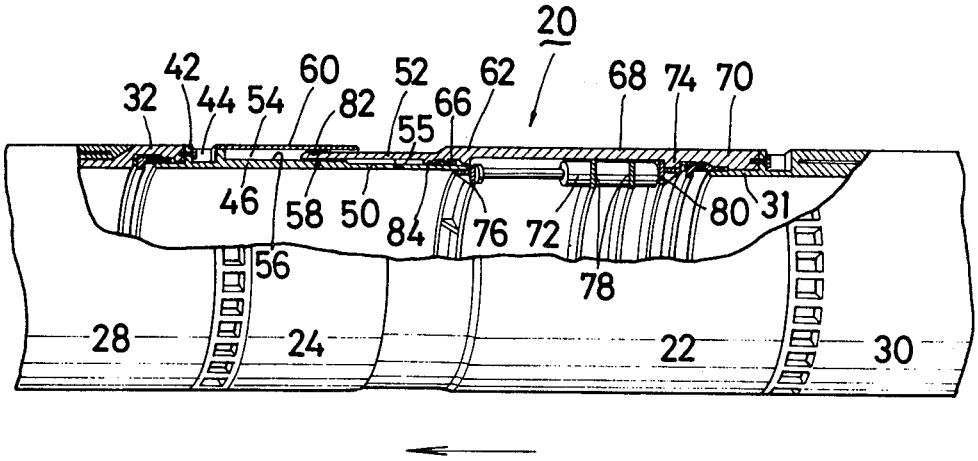
FIG. 8 is a view similar to FIG. 7, and showing the pipe assembly while the intermediate jacks are in operation, the view corresponding to FIG. 6(II)

The intermediate jacks 72, when in the state shown in FIGS. 6(I) and FIG. 7, are operated by actuating an unillustrated hydraulic pump disposed either inside or outside of the pipe assembly, whereby the spigot member 24 is advanced in the direction of the arrow by a distance corresponding to one stroke *a* (FIG. 6(II)) of the jacks. The spigot member 24 is guided by the sliding portion 58, with the result that the series of interconnected pipes 28, 28, . . . as connected to the spigot member 24 are propelled forward by distance *a* (FIG. 6(II) and FIG. 8). At this time, the rearward spigot end 50 of the spigot member 24 moves forward relative to the rubber sealing ring 66, (FIGS. 4 and 5), while being held in sealing contact therewith, since the spigot end 50 has a sufficient length. Subsequently, base jacks 86 (FIG. 6) provided in a rear starting pit 90 are operated, propelling the series of interconnected pipes 30, 30, . . . by a distance corresponding to one stroke *b* of the base jacks. When the intermediate jacks 72 and base jacks 86 are set for equal strokes, namely, $a = b$, the operation of the base jacks 86 will telescopically return or collapse the intermediate sleeve to the original state. Consequently, the whole pipe assembly, including the series of pipes 28, 28 . . . , intermediate sleeve 20 and the other series of pipes 30, 30, . . . , is advanced by the above operation a distance corresponding to one stroke of the base jacks 86 (FIG. 6 (III)). During the return or collapse of the intermediate sleeve 20, the spigot end 50, of course, is held in sealing contact with the rubber ring 66. This operation, when repeated, ultimately advances the overall assembly by a distance corresponding to the length of one pipe, whereupon another section of pipe 30*a* is joined to the rear end of the rearmost pipe 30, and the rear end of the pipe 30*a* is held in place by the base jacks 86. Subsequently, the foregoing operation is repeated, thereby ultimately forcing the foremost end of the pipe assembly to a terminal pit 91 to complete the run or installation of the pipeline comtemplated. The intermediate jacks 72 are then removed, rendering the intermediate sleeve 20 usable as part of the pipeline as it is. The rubber ring 66, although subjected to sliding contact with the rear spigot end 50 frequently during the telescoping movement of the intermediate sleeve 20, retains its function free of any degradation, since the frequency of the telescoping movement is relatively low. Because the intermediate sleeve described above includes a sealing portion 66 provided between the socket member and the spigot member prior to installation, along with other mentioned seals 82 and 84, the improved intermediate sleeve assembly hereof will be made serviceable as part of the completed pipeline merely by removing the intermediate jacks upon the completion of installation. Thus, the improved intermediate sleeve assembly of this invention eliminates the cumbersome operation which would otherwise be needed to provide a seal at an intermediate portion of the underground pipeline installed.

Proceeding to another feature of this invention, the space 54 adjacent the sliding portions of the intermediate sleeve, is filled with a lubricant at all times in order to completely seal off the portion against soil or sand. Thus, to show this feature, reference is made to another illustrative embodiment of intermediate sleeve 120 shown in FIG. 9 wherein the parts corresponding to those in the foregoing embodiment are referred to by the same reference numbers of the latter plus the prefix 100. A space 154 is defined by a cover plate 160, the latter adapted to help prevent the ingress of soil or sand into the outer peripheral surface 156 of an intermediate portion 146 of a spigot member 124. With the intermediate sleeve 120 positioned in its collapsed state, the space 154 has been reduced since the front end 152 of a socket member 122 is shown in the solid-line position, whereas when the spigot member 124 is extended, changing the relative position of the front end 152, the space 154 is enlarged or expands like that shown at 54 in FIG. 8. An aperture 180 extends radially from the inner surface of the member 124 into the space 154 and is provided with an adapter 190 screwed therein for feeding a lubricant 192 to the space 154. A container 191 containing the lubricant 192 is equipped with a suitable pump 193 for injecting the lubricant 192 under pressure into the space 154. The pump 193 is connected to the adapter 190 by a hose 194. The pump 193 may be of the electrically operated type, in which case it has an electrical conductor wire with an end plug 195 for connection to a power supply.

When intermediate jacks 172 are operated, advancing the spigot member 124 and increasing the space 154, the pump 193 is actuated at the same time, whereby the lubricant 192 is fed to the enlarging space 154 with sufficient pressure to exclude entry of foreign material. Further, when the base jacks 86 (FIG. 6) are operated, collapsing the intermediate sleeve 120, the pump 193 is disconnected from the power supply, permitting the lubricant 192 to return to the container 191 upon a decrease of the space 154. These operations are repeated with the extension and collapsing of the intermediate sleeve 120. The lubricant 192 thus always fills the space 154 which increases and decreases in size attendant the extension and collapsing of the intermediate sleeve 120. In this manner, it completely prevents the ingress of soil, sand, or other foreign material, into the space 154 and allows the intermediate sleeve 120 to telescopically move smoothly at all times as guided by the sliding portion 158 thereof.

Figure 9:
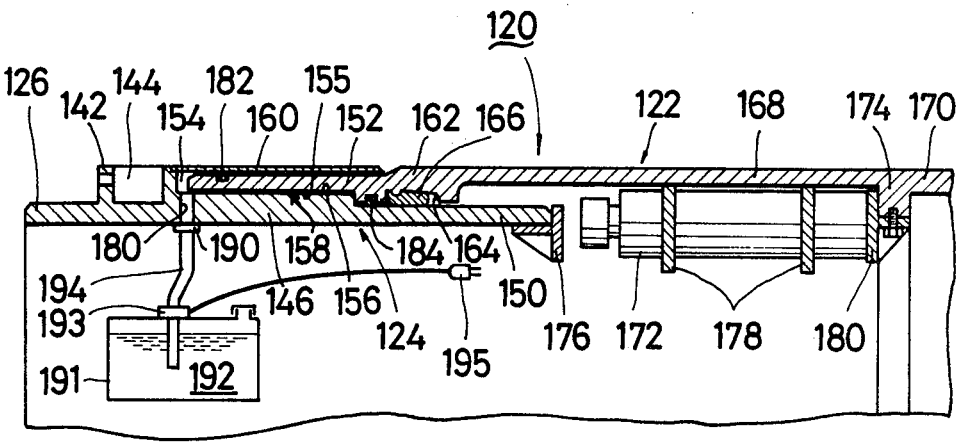
FIG. 9 is a fragmentary longitudinal cross-sectional view of another intermediate sleeve embodying this invention and provided with means for feeding a lubricant.
Figure 10:
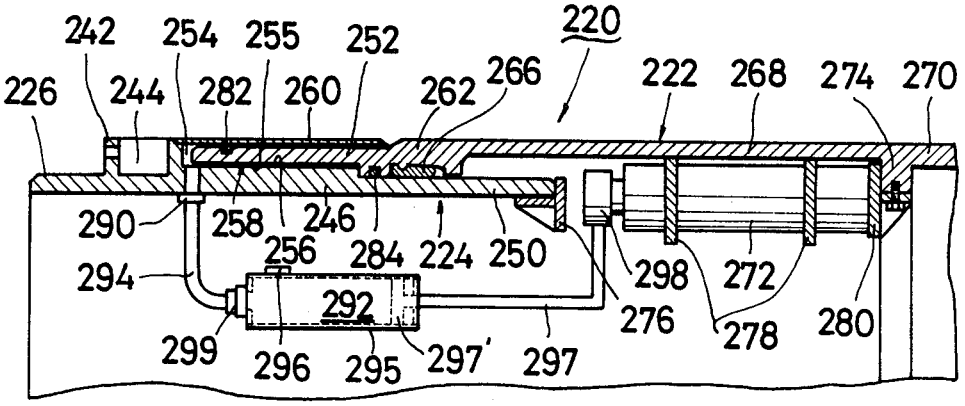
FIG. 10 is a view, similar to FIG. 9, showing a modification of the intermediate sleeve of FIG. 9.

FIG. 10 shows a modification of the embodiment shown in FIG. 9, wherein the parts corresponding to those in the previous embodiments are referred to by the same reference numbers plus the prefix 200. The pump 193 of FIG. 9 is replaced in FIG. 10 by a cylinder 295 operable by an intermediate jack 272 to feed a lubricant 292. The lubricant 292 filling the cylinder 295 is placed thereinto through an inlet 296. The cylinder 295 houses a piston 297' which is connected by a rod 297 to a propulsion transmitting cap 298 on the front end of the intermediate jack 272. A hose 294 extends from a forward port 299 in the front end of the cylinder 295 to an adapter 290. The operation of the intermediate jack 272 advances the piston 297' in the cylinder 295, forcing out the lubricant 292 from the cylinder 295 into the space 254 upon the increase of the space 254 due to the outward displacement of a spigot member 224. When the aforementioned base jacks 86 (FIG. 6) are operated, collapsing the intermediate sleeve 220, the intermediate jacks 272 also collapse, thereby helping withdraw and permitting the return of the lubricant 292 from the space 254 into the cylinder 295.

Figure 11:
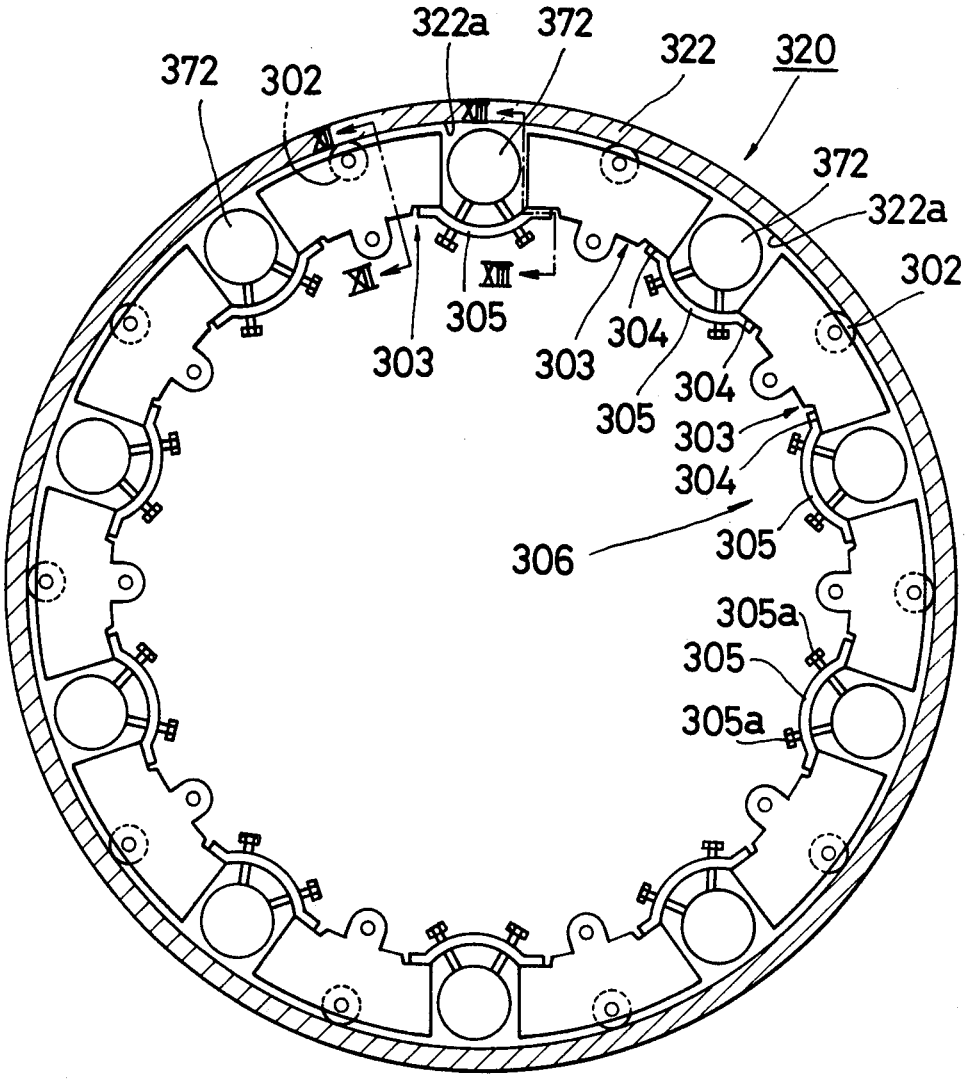
FIG. 11 is a transverse vertical cross-section taken through another form of intermediate sleeve embodying this invention, the view showing in elevation, means for supporting the intermediate jacks.
Figure 12:
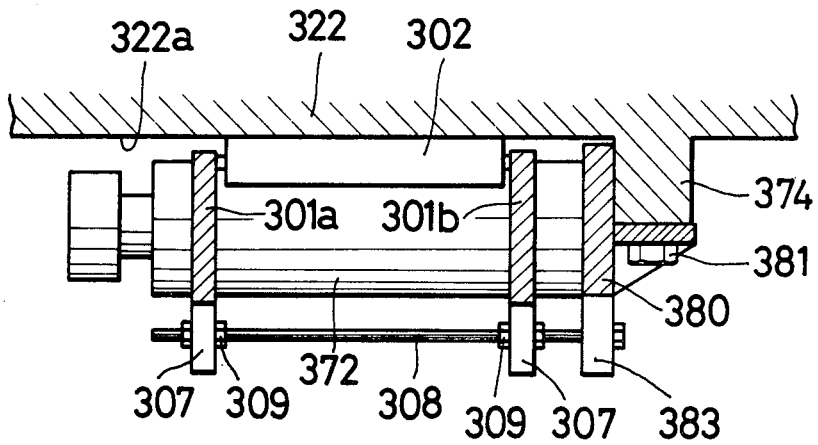
FIG. 12 is an enlarged fragmentary cross-sectional detail view taken along the line XII—XII in FIG. 11.
Figure 13:
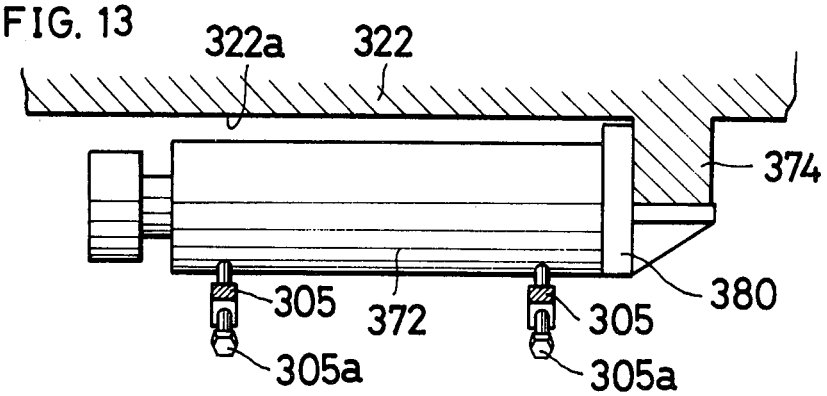
FIG. 13 is another enlarged detail sectional view taken along the line XIII—XIII in FIG. 11.
Figure 14:
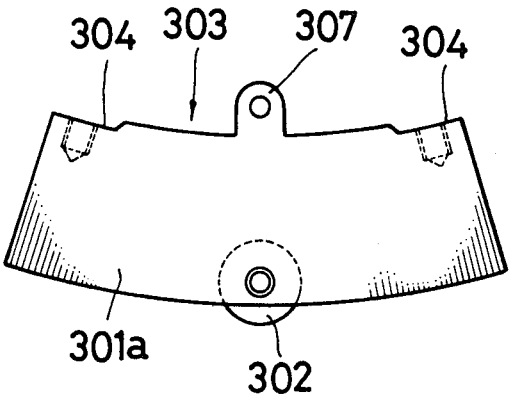
FIG. 14 is a front elevational view showing a unit assembly constituting the jack supporting means of FIG. 11.
Figure 15:
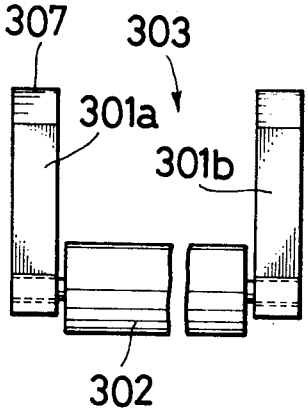
FIG. 15 is a side elevational showing the unit assembly of FIG. 14.

FIGS. 11 to 15 show another intermediate sleeve generally designated at 320 embodying this invention and provided with novel means for supporting jacks. The jack supporting means has the following feature. FIGS. 14 and 15 show a unit assembly 303 comprising a pair of front and rear support plates 301*a* and 301*b*, respectively, which are substantially in the form of an arcuate sector. A roller 302 is provided between and supported by the plates 301*a* and 301*b*. A number of such unit assemblies 303 are arranged and suitably mounted along the inner peripheral surface 322*a* of a socket member 322 at a suitable spacing. An example of suitable mounting means are support members 305 which have opposite ends thereof interconnect the opposed side ends 304 of the adjacent unit assemblies 303 on the inner peripheral edges thereof, whereby the unit assemblies 303 are fabricated into an annular support structure broadly designated 307 in FIG. 11. Intermediate jacks 372 are supported by the members 305 as disposed between the support members and the inner peripheral surface 322*a*. The unit assemblies 303 are rollable on the peripheral surface 322*a*, with the rollers 302 in contact with the surface 322*a*. The assembled support structure 306 is therefore rotatable on the inner peripheral surface 322*a*. A pair of bolts 305*a* for locking the intermediate jack 372 extends through each of the connectors 305 from the center side of the sleeve outward thereof as seen in FIGS. 11 and 13. The distal ends of the bolts bearing against the intermediate jack 273 toward the inner peripheral surface 322*a* retain the jack 372 in place, free of any backlash and against escape from the support members 305. The locking bolts 305*a*, when screwed at the distal ends thereof into the outer peripheral surface of the intermediate jack 372, can completely lock the jack in position as illustrated in FIG. 11. Consequently, the intermediate jacks 372 at a lower portion of the sleeve shown in FIG. 11 are supported above the inner peripheral surface 322*a* of the socket member in suspension.

The supporting means will be assembled in the following manner. An intermediate jack support 380 (FIG. 12), divided into three or four portions in its circumference, is secured by bolts 381 to a rib 374 on the socket member 322 for receiving the counterforce of the intermediate jacks. Projecting inwardly from the inner peripheral edge of the jack support 380 are brackets 383 for temporarily holding the unit assemblies 303 to be mounted. Corresponding to the brackets 383 are brackets 307 (FIGS. 12, 14 and 15) projecting from the inner peripheral edges of the support plates 301*a* and 301*b* of the unit assemblies 303. The unit assemblies 303 are arranged along the inner peripheral surface 322*a* of the socket member 322 as stated before, and are held to the brackets 383 by bolts 308 and nuts 309 (FIG. 12) extending through the brackets 383 and 307. The support members 305 are then secured, each at its opposite ends, to the opposed side ends 304 of the adjacent unit assemblies 303 on the inner peripheral edges thereof, whereby the unit assemblies 303 are interconnected to one another into the aforementioned support structure 306 for mounting within the socket member 322. The bolts 308 and nuts 309 (FIG. 12) are then removed from the assembled support structure 306 thus rendering the structure 306 freely rotatable on the inner peripheral surface 322*a* of the socket member 322. At a lower portion of the socket member, an intermediate jack 372 is then inserted into the space defined by the cradle-like support members 305 between two adjacent unit assemblies 303 and by the inner peripheral surface 322*a*, being inserted through a space between the members 305 and the rear end of an unillustrated spigot member. The locking bolts 305*a* are thereafter rotated so as to push the intermediate jack 372 toward the inner peripheral surface 322*a*, whereby the jack 372 is held in place against any displacement. This novel arrangement permits the intermediate jacks 372 to be mounted in place at the lower peripheral position, whereupon the support structure 306 is suitably rotated sufficiently to bring an adjacent upper portion thereof to the lower position, where additional intermediate jacks 372 are progressively installed in the same manner as above. Thus, all the intermediate jacks 372 to be arranged over the entire inner circumference of the socket member 322 can be more readily installed in place at the lower portion of the socket 322. The intermediate jacks 372 are removable by following the above procedures in the reverse order.

The use of the support means greatly facilitates the mounting and removal of the intermediate jacks, without incurring potential hazard of dropping a jack during mounting. The unit assemblies 303, which weigh considerably less than the jacks, are easy to install within the socket member 322. Accordingly, the operation of mounting and dismounting of the jacks, including the fabrication of the supporting means, can be carried out with an exceedingly high efficiency heretofore unattainable.

What is claimed is:

1. An improved intermediate sleeve means for use in installing and becoming an integral part of an underground pipeline unable to be installed via conventional excavating of an open ditch, but which pipeline is installed by propelling in a known manner successive sections of pipe forming a pipeline assembly through a sub-terrainean medium with the aid of expansible-contractible jack means in an initial starting pit, and with the aid of an intermediate sleeve means together with associated intermediate expansible-contractible jack means collectively interposed between collective pluralities of interjoined pipeline sections, with said intermediate sleeve means thus becoming integrally incorporated in one or more intermediate portions of the completed pipeline assembly; said improved intermediate sleeve means comprising the combination of:

(a) an annular sleeve-like socket member constituting an outer pipe member;

(b) an annular sleeve-like spigot member constituting an inner pipe member;

(c) said inner and outer pipe members including, respectively, complementally formed annular sleeve portions adapted for telescopic relative movement;

(d) annular sealing means interposed between radially adjacent movable portions of said spigot and socket members at an area generally intermediate opposite ends thereof for effectively sealing off predetermined portions of said spigot and socket members while permitting relative sliding movement of said members; and (e) said sealing means including an annular compressively resilient seal of a self-sealing type adapted to be progressively flattened during telescopic assembly of and between said socket and spigot members, and which provides surface pressure required to assure sealing of the interior from the exterior when subjected to predetermined internal pressures which may flow through said improved intermediate sleeve means and finished pipeline assembly.

2. Intermediate sleeve means as defined in claim 1, wherein each of said socket and spigot members are provided with radial flange means disposed interiorly of the intermediate sleeve means and transversely to a common longitudinal axis thereof;

said respective radial flange means being provided in association with respectively rearward portions of said respective socket and spigot members, and in an axially spaced-apart relation;

said spigot members further having a radially outward flange at a generally forward end portion and adapted for bearing contact with an adjacent portion of a pipe section being installed in said pipeline assembly;

the aforesaid first-mentioned radial flange means of said socket and spigot members adapted to receive therebetween opposite operative ends of intermediate expansible-collapsible jack means removably interposable therebetween for imparting supplemental driving pressure to the telescopically expansible spigot member and to the pipeline sections being installed via said radially outward flange of said spigot member.

3. Intermediate sleeve means as defined in claim 1, further comprising an annular outer cover plate covering the relative sliding portions of said socket and spigot members which otherwise would be exteriorly exposed, the cover plate adapted to prevent ingress of soil or sand of the sub-terrainean medium;

said spigot member having an aperture through a wall portion to provide communication from the interior of the intermediate sleeve with an annular space beneath said outer cover, the space providing a sliding area for telescopic movement of said annular sleeve portion socket member upon an annular sleeve portion of the said spigot member;

lubricant-feeding means connected with said aperture for feeding a lubricant under pressure into the said annular space and for withdrawing the lubricant therefrom via said aperture responsive to respective increase and decrease of the space beneath said cover plate resulting from the relative telescopic movement of said socket and spigot members, thus more positively excluding ingress of soil or sand into the moving parts of the intermediate sleeve.

4. Intermediate sleeve means as defined in claim 2, further comprising:

an annular outer cover plate covering the relative sliding portions of said socket and spigot members which otherwise would be exteriorly exposed, the cover plate adapted to prevent ingress of soil or sand of the sub-terrainean medium;

said spigot member having an aperture through a wall portion to provide communication from the interior of the intermediate sleeve with an annular space beneath said outer cover, the space providing a sliding area for telescopic movement of said annular sleeve portion socket member upon an annular sleeve portion of the said spigot member;

lubricant-feeding means connected with said aperture for feeding a lubricant under pressure into the said annular space and for withdrawing the lubricant therefrom via said aperture responsive to respective increase and decrease of the space beneath said cover plate resulting from the relative telescopic movement of said socket and spigot members, thus more positively excluding ingress of soil or sand into the moving parts of the intermediate sleeve.

5. Intermediate sleeve means as defined in claim 3, wherein said annular sealing means interposed between radially adjacent movable portions of said spigot and socket members, further include two axially spaced annular sealing rings; one of said rings interposed between forwardmost portions of said outer annular cover and said socket member; and the other of said rings interposed also between the radially adjacent movable portions of said spigot and socket members spaced axially rearward from said first-mentioned ring, but axially forward of said initially first-mentioned annular compressively resilient self-sealing type seal.

6. Intermediate sleeve means as defined in claim 4, wherein said annular sealing means interposed between radially adjacent movable portions of said spigot and socket members, further include two axially spaced annular sealing rings; one of said rings interposed between forwardmost portions of said outer annular cover and said socket member; and the other of said rings interposed also between the radially adjacent movable portions of said spigot and socket members spaced axially rearward from said first-mentioned ring, but axially forward of said initially first-mentioned annular compressively resilient self-sealing type seal.

7. Intermediate sleeve means as defined in claim 1, further comprising a plurality of arcuate unit assemblies with means for circumferentially interconnecting them to comprise a circular jack-mounting means for mounting therewith a plurality of circumferentially-spaced intermediate expansible-contractible jacks; said circular jack-mounting means arranged along the inner peripheral surface of said socket member near a rearward end thereof; each of said unit assemblies including a pair of axially spaced apart support plates for supporting and including a roller therebetween having an axis disposed parallel to the center axis of said intermediate sleeve; said rollers adapted to rollably engage the inner peripheral surface of said socket member; the aforesaid means for circumferentially interconnecting said arcuate unit assemblies also constituting support means for the intermediate jacks; and a plurality of intermediate expansible-contractible jacks supported within said circular jack-mounting means in circumferentially predetermined places adjacent the inner peripheral surface of said socket member, with opposite axial ends of said jack means adapted to operatively engage force-bearing-surfaces provided at corresponding circumferentially disposed places on generally rearward but spaced-apart portions of said respective spigot and socket members.

8. Intermediate sleeve means as defined in claim 2, further comprising a plurality of arcuate unit assemblies with means for circumferentially interconnecting them to comprise a circular jack mounting means for mounting therewith a plurality of circumferentially-spaced intermediate expansible-contractible jacks; said circular jack-mounting means arranged along the inner peripheral surface of said socket member near a rearward end thereof; each of said unit assemblies including a pair of axially spaced apart support plates for supporting and including a roller therebetween having an axis disposed parallel to the center axis of said intermediate sleeve; said rollers adapted to rollably engage the inner peripheral surface of said socket member; the aforesaid means for circumferentially interconnecting said arcuate unit assemblies also constituting support means for the intermediate jacks; and a plurality of intermediate expansible-contractible jacks supported within said circular jack-mounting means in circumferentially predetermined places adjacent the inner peripheral surface of said socket member, with opposite axial ends of said jack means adapted to operatively engage force-bearing-surfaces constituted by said radial flange means disposed interiorly of said respective socket and spigot members.

* * * * *